United States Patent [19]

Dowzall et al.

[11] Patent Number: 4,941,520

[45] Date of Patent: Jul. 17, 1990

[54] FORMULATING PASTY MATERIALS

[76] Inventors: Martin E. Dowzall, 299 Village Pl., Wyckoff, N.J. 07481; Vazgen J. Houssian, 389 Mountain Rd., Union City, N.J. 07087

[21] Appl. No.: 87,006

[22] Filed: Aug. 18, 1987

Related U.S. Application Data

[63] Continuation-in-part of Ser. No. 863,978, May 16, 1986.

[51] Int. Cl.[5] ..... B65B 35/28; B01F 11/00; G55B 1/00

[52] U.S. Cl. ..... 141/114; 141/21; 141/25; 141/95; 141/100; 141/105; 141/313; 141/320; 366/605; 366/130; 206/219; 222/103; 222/106; 222/158

[58] Field of Search ..... 141/3, 19, 320, 322, 141/313, 21–29, 1, 9, 11, 114, 69, 94, 95, 100, 103–105, 392; 604/82, 207, 407; 222/103, 106, 95, 158, 327; 366/605, 129, 130, 189, 160; 206/219, 220; 215/366, 11 E, 365; 73/861.04, 426, 428

[56] References Cited

U.S. PATENT DOCUMENTS

| | | | |
|---|---|---|---|
| 1,533,753 | 4/1925 | Munch | 604/207 |
| 1,832,436 | 11/1931 | Wagenseller | 73/428 |
| 2,354,477 | 7/1944 | Radbruch | 222/158 |
| 2,528,530 | 11/1950 | Machleder | 206/222 |
| 2,638,250 | 5/1953 | Houldsworth | 222/103 |
| 2,798,488 | 7/1957 | Hall | 366/130 X |
| 2,819,738 | 1/1958 | Marberg | 141/1 |
| 2,830,396 | 4/1958 | Gowland | 141/313 X |
| 3,248,012 | 4/1966 | Adams | 222/95 |
| 3,261,381 | 7/1966 | Roach | 141/114 |
| 3,595,279 | 7/1971 | Jaffe | 141/2 |
| 4,105,142 | 8/1978 | Morris, Jr. | 222/158 |
| 4,197,017 | 4/1980 | Whelan | 366/343 |
| 4,316,556 | 2/1982 | Ferrari | 222/95 |

FOREIGN PATENT DOCUMENTS

| | | | |
|---|---|---|---|
| 1146853 | 8/1959 | Fed. Rep. of Germany | 366/129 |
| 2039622 | 8/1980 | United Kingdom . | |
| 2065784 | 7/1981 | United Kingdom . | |
| 2106794 | 4/1983 | United Kingdom . | |

*Primary Examiner*—Ernest G. Cusick
*Attorney, Agent, or Firm*—Darby & Darby

[57] ABSTRACT

Apparatus for formulating pasty materials comprising a set of supply containers each containing a pasty material and each having an extrusion nozzle. A receiving tube is adapted to fit on each extrusion nozzle. An element is included for stimating the amount of material extruded from a selected container of the set into the receiving tube when the tube is fitted on one of the extrusion nozzles. The receiving tube is of flexible material to allow pasty material extruded into the tube to be ejected from the tube by application of a traveling pinching action along the tube. The apparatus may include a container for the receipt of such ejected material and an element for stirring or mixing to homogeneity material in the container.

9 Claims, 3 Drawing Sheets

5
6
7
4
2

5
7
6
4
2

5
3
7
6
4
2
1

FORMULATING PASTY MATERIALS

CROSS-REFERENCE TO RELATED APPLICATIONS

This is a continuation-in-part application of Ser. No. 06/863,978 filed May 16, 1986.

FIELD OF THE INVENTION

This invention relates to formulating pasty materials and to apparatus for use in doing so. It is of particular value in color mixing, but it can be used for analogous systems where it is desired to mix two or more pasty materials together in controlled proportions to make an appropriate formulation.

BACKGROUND OF THE PRIOR ART

Many paints are customarily available in pasty form. Mixing paint of a particular color is generally done by eye. This is a satisfactory process for small scale work such as, e.g., making an oil painting, but it is unsatisfactory for many graphic arts and commercial purposes, particularly if a match to a particular color is desired. Even though in the hands of a skilled person, a close match may be obtained, an exact match is very difficult to achieve, particularly having regard to the fact that the color or the wet paint is different from the color of the paint when it is dry, particularly with water-based systems.

Even if the user is assisted by some sort of mixing or formulation guide, he or she has no easy and accurate method of measuring the relative volumes of material necessary and subsequently mixing them evenly to give the desired final color. U.K. Specification No. 2106794 purposes a system for measuring accurately small quantities of viscous colored liquids for use in paint formulation, but such a system is impractical for doing color formulation. It is effectively useful only for tinting white or natural bases to alter the color slightly.

The problems referred to above are compounded in the case of color matching or color proofing systems in which it is desired not only to produce a given color, but also to produce a specific mixed volume of that color, e.g., sufficient to cover a proofing sheet completely but without leaving any material excess and without incomplete coverage at any point.

We have now found that the disadvantages noted above may be avoided and accurate formulation of pasty materials obtained using a sequential extrusion technique as explained below.

SUMMARY OF THE INVENTION

In accordance with the first feature of the present invention, there is provided a method of formulating pasty materials together which comprises extruding successively given amounts of pasty material from a storage container into a tube, there being associated with the tube a set of graduations which are used to estimate the given amounts, ejecting the total quantity of pasty material from the tube, and mixing the same to homogeneity. Preferably mixing takes place in a container from which the homogeneous mixture can subsequently be extruded.

The present invention also provides apparatus for formulating pasty materials comprising a set of supply containers each containing a pasty material and each having an extrusion nozzle, a receiving tube adapted to fit on each extrusion nozzle and means for estimating the amount of material extruded from a selected container of the set into the receiving tube when the tube is fitted on one of the extrusion nozzles. The receiving tube is of flexible material to allow material extruded into the tube to be ejected the tube by application of a traveling pinching action along the tube. The apparatus may include a container for the receipt of such ejected material, and means for stirring or mixing to homogeneity material in the container.

The tube and graduations may be integral, or separate. For example, the tube may be a rigid plastics or glass tube with graduations marked on it. This is, however, not preferred. It is more preferable to use as the tube a thin walled, even bore plastic tube from which material may be ejected by pinching the tube flat at one point and then moving the pinch toward the material in the tube whereon it is moved along the tube and out of its end, and to provide the graduations on a tube holder, e.g., of rigid plastics or glass. This enables accurate graduations to be used. The holder may be, e.g., an outer tube into which the plastics tube may be slid. Graduations may also be printed or embossed on a thin walled plastics tube, but this is less preferred.

The tube for receipt for the pasty material may be so shaped and dimensioned that it is simply a press fit over the nozzles of the various containers of different materials. Alternatively a suitable adaptor may be used to effect a relatively fluid-tight seal between one end of the tube and the nozzle. Tubes for different sizes may be provided for formulating relatively small or relatively large quantities of pasty material together. Generally, the total internal volume of the tube will be a fixed volume in the range from 2 to 10 ml. Narrower diameter tubes provide greater control over the accuracy of the component amounts used to arrive at a desired color of mixed pasty material.

In use of such apparatus, the tube is placed over the first nozzle of one of the containers and material extruded into it up to a desired graduation. The tube is then removed, placed over the next nozzle and further extrusion of material into the end of the tube over the nozzle then takes place until the free surface of the pasty material in the tube has reached the next appropriate graduation. This process is repeated until all of the ingredients of the formulation have been inserted into the tube, whereafter the tube is emptied.

The tube is conveniently of round cross-section, though other cross-sections could be used. Different cross-sections of tubes may be used for formulating different total quantities of materials. The graduation may vary to suit the system in question, a convenient system being graduations from 0 to 100 divided into 10 units each of 10 graduations. The length of the tube may be any convenient length, for example, 10 cm to 25 cm.

In a particularly preferred embodiment the extrusion nozzle is fitted with an adaptor which is sized for the receipt of either a wider diameter larger capacity flexible tube and its associated tube holder or outer tube, or narrower diameter, smaller capacity flexible tube and its associated tube holder or outer tube. The adaptor may have two concentric shoulders for accurate and repeatable axial location of the smaller and larger diameter inner tubes. The outer of the two shoulders may serve to locate the graduated outer tube or tube holder repeatably.

The adaptor may also include valve means enabling material to be extruded into the tube but not to be sucked back from the tube, as might happen if the pasty material were contained in a resilient supply container such as a plastics squeeze bottle.

The major advantage of the system is that it enables the consistent and accurate formulation of uniform quantities, e.g. 5 ml each time, of mixed pasty material. By separating the graduations from the tube itself, e.g. printing them on a tube holder or outer tube, consistency and accuracy can be achieved economically. In addition, the tube can be a disposable item, once the successive amounts of material extruded into it have been ejected, can simply be discarded. The ejector may be e.g. a simple plastics moulding which may then be used as a stirrer to mix the ejected material to homogeneity and then itself be thrown away. Even the mixing container may be disposable if desired.

Once the homogeneous mix has been made, it may be used in any desired fashion, e.g. applied with a brush, palette knife, sponge or other applicator to the desired article or surface. In the case of color proofing systems, the material may be laid down as a bead of pasty material along one edge of a suitable substrate and then coated across that substrate using a drawdown bar. Even coating may be assisted by laying down an even bead, e.g. by extrusion via a container lid using a movable container base as a piston.

The method and apparatus of the present invention may be used in a wide variety of mixing and formulating applications for graphic arts and analogous purpose. In addition to use in color matching or color proofing systems noted above, the invention is also of value in mixing non-photosensitive materials, for example paints, e.g. acrylic based paints and for mixing printing inks, either silk screen or lithographic, e.g. offset inks or other pasty ink types.

BRIEF DESCRIPTION OF THE DRAWINGS

The invention is illustrated with reference to the formulation of colored pasty materials for use in a color proofing system and with reference to the accompanying drawings in which.

DESCRIPTION OF THE PREFERRED EMBODIMENTS

In a partical color proofing system a number of color-based material may be used, but for simplicity of illustration the case is considered of the production of a somewhat de-saturated orange coating, for example, to produce the color PANTONE 164 (PANTONE is a Registered Trade Mark).

In order to do this, the user must first look up the desired formula in a formulation book. We take as a simplified example that the formulation calls for three parts of red base material, three parts of yellow base material and four parts of white base material.

Figures 1, 2, 3:
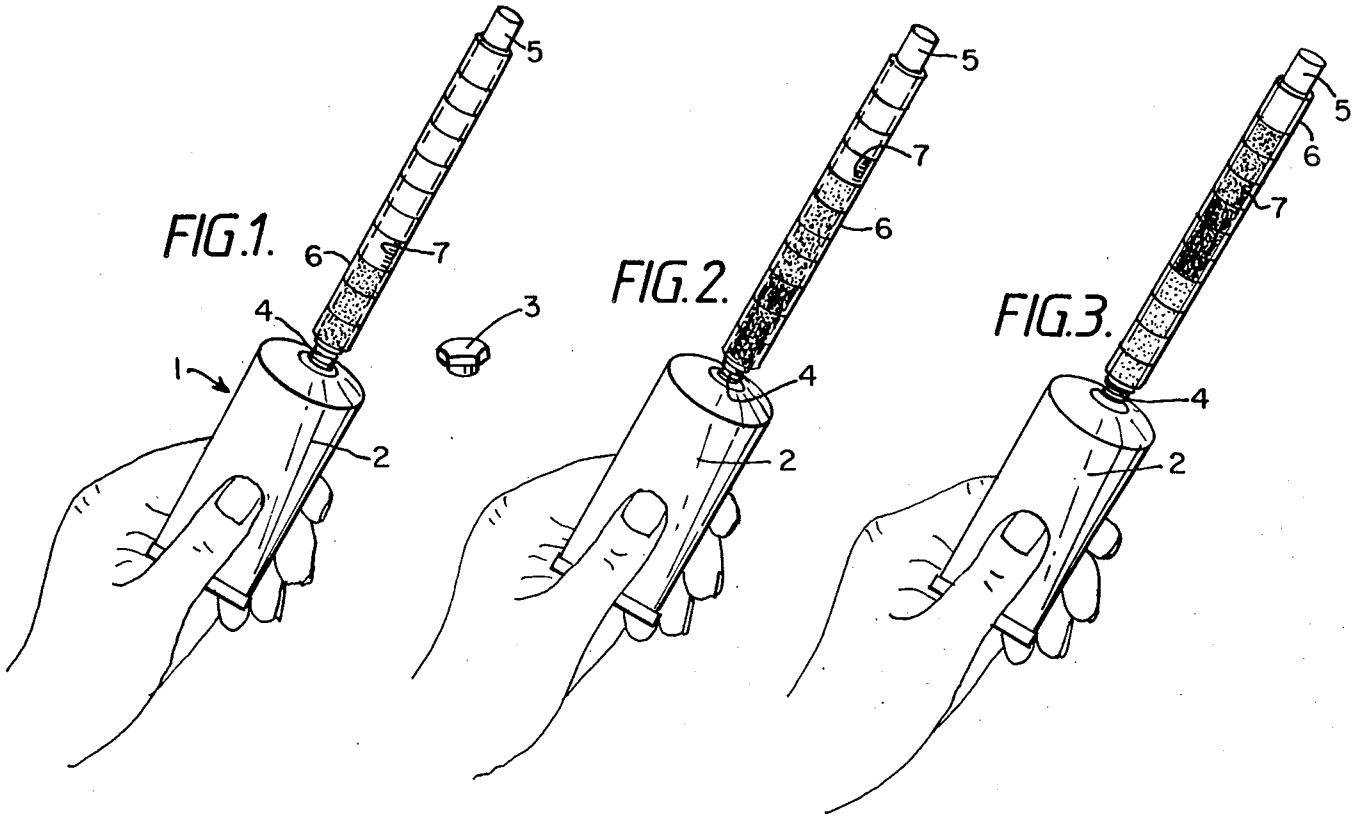
FIG. 1 shows a first extrusion step.
FIG. 2 shows a second extrusion step.
FIG. 3 shows a final extrusion step.

The base materials are provided as illustrated in FIGS. 1 to 3 in squeeze tubes 1 of substantially conventional type consisting of a squeezable tube 2 having integrally formed at its top an externally screw-threaded extrusion nozzle 4, on to which an internally threaded closure cap 3 is normally applied for storage. The sqeeze tube may be made of lead/aluminium alloy foil or plastics. Such tubes are convenient, but other convenient containers with an extrusion nozzle, e.g. squeeze bottles which will provide positive displacement, or a plastics bottles or jars, fitted with a lid with a pump in it for extruding pasty material when operated may be used. A valve arrangement may be disposed in the extrusion nozzle to prevent sucking back of dispensed material. Use of a container with a pump in its lid is advantageous if there is a tendency for the paste, on standing, to become inhomogeneous, as the pump can be used as a stirrer before dispensing starts.

In the simple system shown in FIGS. 1 to 3, a flexible thin-walled tube 5 is a press fit over the external threaded surface of the extrusion nozzle 4 of the squeezable tube. Tube 5 is a transparent tube of polyvinyl chloride having an internal diameter of 6 mm and a wall thickness of 0.5 mm. It is surrounded on its exterior by a methacrylate plastics transparent tube 6 having a scale of graduations 7 on it. Tube 5 is a snug fit inside tube 6 so that once inserted there is little tendency to axial movement between the two. With inner tube 5 press fitted over the nozzle 4, the tube 2 is squeezed to extrude color material into the tube 5 up to the 30 units graduation marking, as shown in FIG. 1. The assembly of inner and outer tubes 5, 6 is then pulled off and placed on the next tube 2, and further material squeezed into the tube 5 from the tube 2 shown in FIG. 2 until the rising surface of pasty material in tube 5 reaches the 60 units graduation mark.

The two tubes 5 and 6 are now removed and, as shown in FIG. 3, placed on the nozzle of a corresponding white base containing container 2 from which a further 40 units of white material are extruded into the tube 5 to bring the free end type of pasty material up to the 100 mark. (The marks 0 to 100 are not expressly indicated in FIGS. 1–3).

Figure 4:
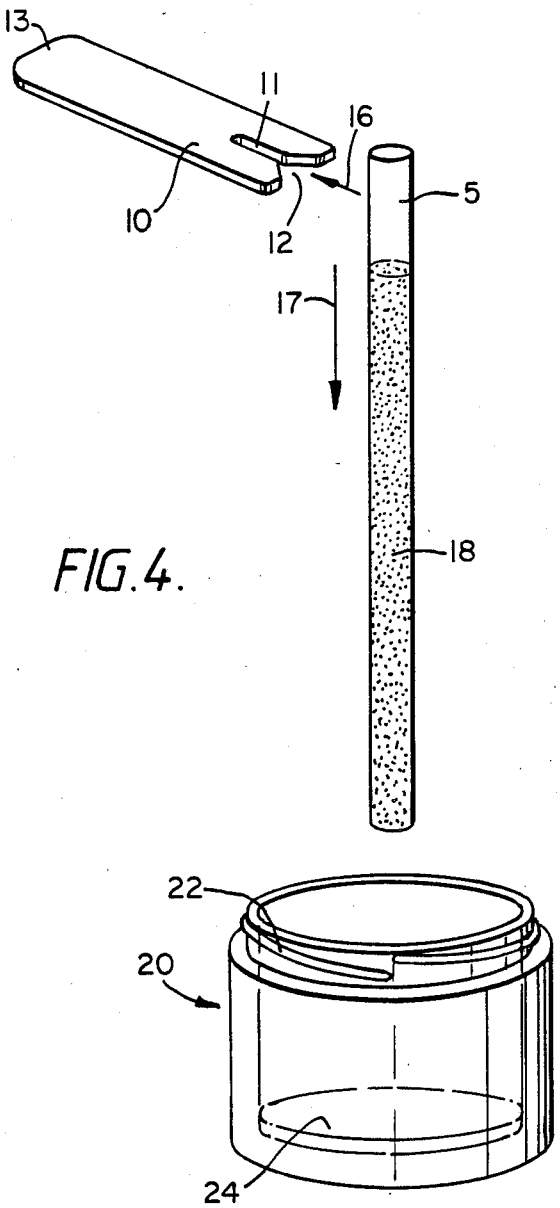
FIG. 4 shows the ejection of material from the tube into a container.

The assembly of inner and outer tubes 5, 6 is now removed form the third container of pasty material and the inner tube 5 removed from the outer tube 6. A disposable tube emptying and stirring tool denoted 10 in FIG. 4 is now used to remove the pasty material (denoted 18) from inside the thin-walled flexible tube 5. The tool 10 consists basically of a rigid strip of plastics material having a slot 11 and throat 12 open at one end, its other end 13 being plain. The transverse measurement of the slot 11 is such that the tube 5 can be introduced via throat 12 into the slot 11 (arrow 16) but when so introduced, the walls of the slot 11 press the two sides of the tube 5 together. The tube is now pulled axially, pulling from its upper empty end, and accordingly as the slot 11 moves along the tube 5 (arrow 17), it pushes the material 18 in the tube 5 before it, so causing material 18 to be extruded from the end of the tube 5. Following such extrusion, tube 5 is empty and collapsed flat, and is simply thrown away. Alternatively, the material 18 may be extruded from tube 5 by hand by pinching the upper end of the tube between thumb and forefinger and then sliding the pinched fingers down the tube until the bottom.

Figure 5:
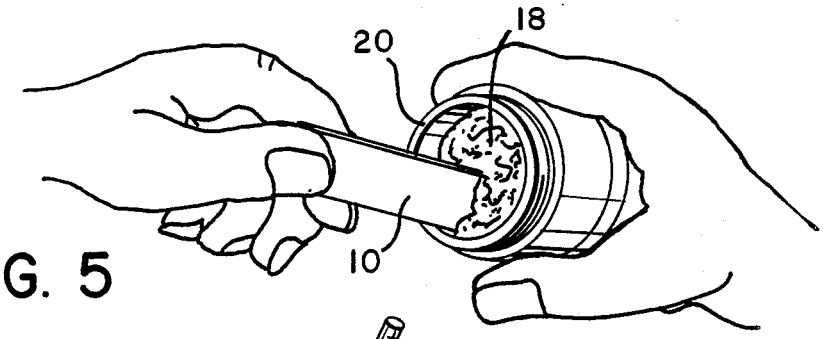
FIG. 5 illustrates the mixing of the material in the container to homogeneity.

The material 18 may be extruded onto a flat surface (e.g., a piece of paper) and, thereafter, mixed with one end of tube 5. The mixed material may be used by an artist directly from the flat surface. The material 18 may also be extruded into a container 20 and mixed as shown in FIGS. 4 and 5.

In practicing color proofing the mixed material is then laid as a bead across a sheet of color test material, and the bead distributed over the sheet of color test material using, e.g. a draw-down coating bar. The sheet may then be dried and put to use in the color proofing or color matching system in question. The color of the mixed material drawn down is accurate because of the use of the formulation guide coupled with the graduations on the tube 6 while the individual components are being extruded into the tube 5. This enables very much more accurate colour matching to be obtained than using previous systems.

Figure 6:
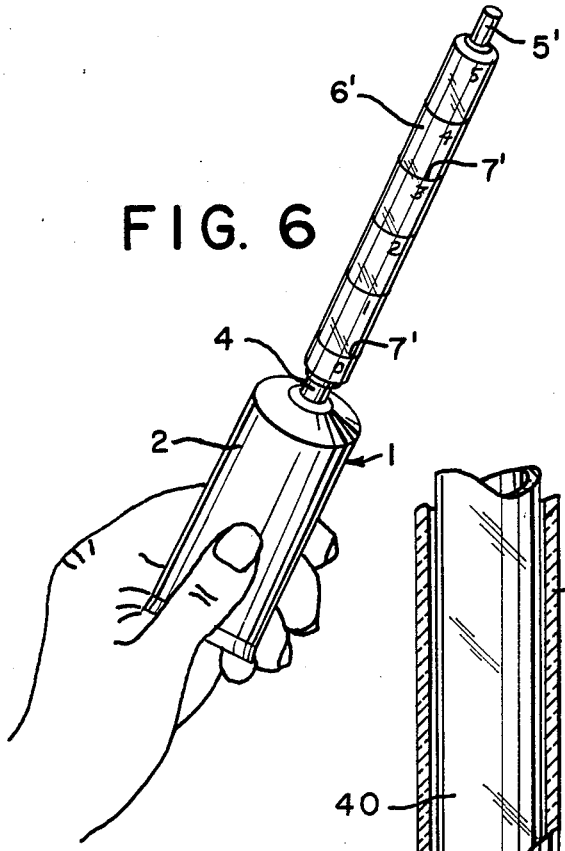
FIG. 6 illustrates an arrangement of a narrower diameter tube for the receipt of extruded material.

It is possible, using the present invention, to achieve great accuracy in mixing pasty materials by employing a tube 5 of even narrower diameter than that shown in FIGS. 1, 2 and 3. In those figures, the tube 5 fits over the nozzle 4 of tubes 2. Reference to FIG. 6 indicates another embodiment where a narrower diameter tube 5' can be inserted within the opening of nozzle 4 so as to be retained by a press fit. Thus, a tube having a diameter of about 3 mm (about one-half of that described with respect to FIGS. 1, 2 and 3) is preferably used. Again, the narrow tube is surrounded on its exterior by a tube 6' having a scale of graduations 7' on it. Tube 5' is relatively snug fit into tube 6'. The scale of tube 6', rather than having graduations of 0 to 100 (representing %), preferably has a set of graduations marked 0 to 5, for example. The indications on the scale of the narrower tube they correspond to the same volume as corresponding indications on the larger diameter tube.

Tube 5' is substantially filled by a smaller amount of each component pasty material for the same relative proportion of each component. Thus, a capability of having more accurate mixing is achieved by the narrower tube.

As shown in FIGS. 1, 2, 3 and 6, the tube 5,5' is simply pressed around or into nozzle 4, and the outer tube 6,6' surrounds tube 5,5'. Clearly the amount of material left in the tube after extrusion and pulling the tube off the nozzle 4 has taken place will vary slightly with any variation in the precise axial positioning of the tubes 5,5', 6,6'. Further variation may be introduced if the squeeze container 2 is resilient and tends to suck material back when thumb pressure is released.

Figure 7:
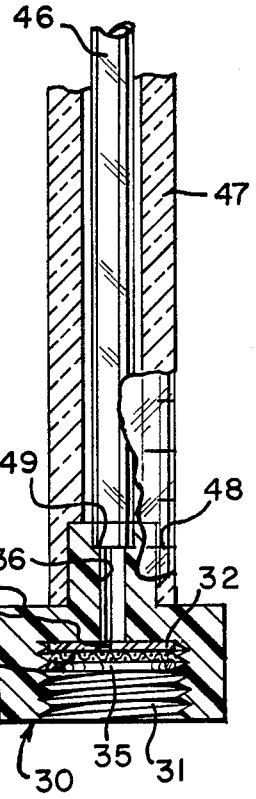
FIG. 7 is a cross-section through a nozzle adaptor and associated tube and outer tube.
Figure 8:
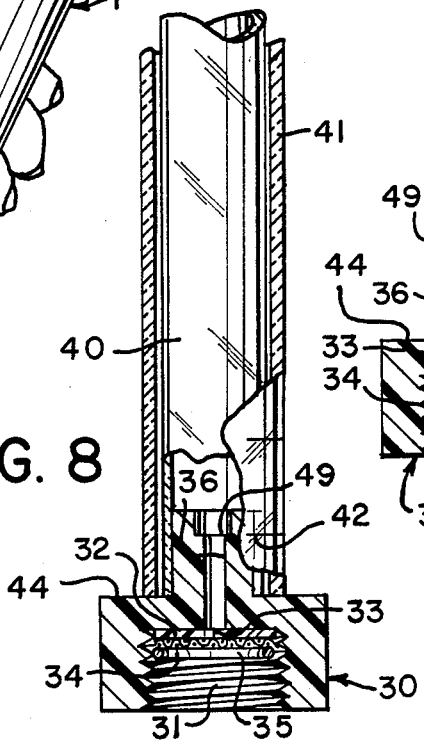
FIG. 8 is a cross section similar to FIG. 7 but with alternative tube and outer tube.

These disadvantages may be avoided by using the arrangement shown diagrammatically in FIGS. 7 and 8. These Figures shown an adaptor 30 which has an internal cylindrical thread 31 for screwing on the nozzle 4.

Internally of the adaptor there is a one way sealing valve arrangement consisting of a rubber disc 32 having a central cruiform slit 33 punched in it, a rigid metal mesh disc 34 and an O-ring 35. When the adaptor 30 is screwed on the nozzle 4, O-ring 35 is compressed and rubber disc 32 held firmly. Adaptor 30 includes a dispensing channel 36 into which the rubber disc adjacent cruciform slit 33 may be deformed under pressure of pasty material which can be pushed through mesh disc 34 by applying pressure to the tube. Movement in the opposite direction cannot be effected because of the support of disc 32 by mesh 34. The adaptor thus acts to enable material to be extruded from a tube 2, but not sucked back thereinto.

The upper portion of adaptor 30 as shown in FIGS. 7 and 8 consists of a cylindrical wall having plain outer surface and a stepped inner surface.

When it is desired to dispense pasty material using a wider bore tube, the arrangement shown in FIG. 8 is used. In that Figure the wider bore thin flexible wall tube is denoted 40 and its associated outer graduated tube holder 41. The zero graduation is indicated at 42. Both tubes 40 and 41 are positively located axially by abutting against an annular shoulder 44. Identical adaptors 30 on other tubes 2 enable precise repeatable positioning of tubes 40 and 41. If smaller quantities or more accurate formulation is required, then the narrower thin walled flexible tube should be used, and this is denoted 46 and is shown in FIG. 7. It can be seen that the axial location of tube 46 is determined by the internal shoulder there denoted 49. The graduated tube associated with tube 46 is denoted 47 and the zero graduation thereon 48 in FIG. 7.

While the foregoing description and drawings represent the preferred embodiments of the present invention, it will be obvious to those skilled in the art that various changes and modifications may be made therein without departing from the tube spirit and scope of the present invention.

What is claimed is:

1. Apparatus for formulating pasty materials comprising:

a set of supply containers each containing a pasty material and each having an extrusion nozzle;

at least one receiving tube, each of said at least one receiving tube being adapted to fit on each extrusion nozzle; and means for estimating the amount of material extruded from a selected container of said set into one of said at least one receiving tube when said at least one receiving tube is fitted on one of said extrusion nozzles; and each of said at least one receiving tube being of flexible material to allow material extruded into said at least one receiving tube to be ejected from said at least one receiving tube by application of a traveling pinching action along said at least one receiving tube and wherein said set of supply containers each contain basic color components from which a pasty material of desired color may be obtained by mixture of specific proportions of two or more of said components, said proportions fro a single color being determined in a single receiving tube.

2. The apparatus of claim 1, wherein each of said at least one receiving tube is a thinwalled, transparent plastic tube.

3. The apparatus of claim 2, wherein each of said at least one receiving tube has at least one bore.

4. The apparatus of claim 2, wherein each of said at least one receiving tube has a diameter allowing for fitting said at least one receiving tube over the nozzle of each container.

5. The apparatus of calim 2, wherein each of said at least one receiving tube has a diameter allowing for fitting said at least one receiving tube within the opening of the nozzle of each container.

6. The apparatus of claim 1, including a receiving surface for receipt of material ejected by one of said at least one receiving tube.

7. The apparatus of claim 1, including a receiving container for receipt of material ejected by one of said at least one receiving tube.

8. The apparatus of claim 6 or 7, includes means for mixing to homogeneity material ejected by one of said at least one receiving tube.

9. The apparatus of claim 1, wherein said at least one receiving tube is flattened by said travelling pinching action and said mixing means include one end of said at least one receiving tube which is flatened.

* * * * *